US006899528B2

(12) United States Patent
Youngpeter et al.

(10) Patent No.: US 6,899,528 B2
(45) Date of Patent: May 31, 2005

(54) POWER STEERING PUMP

(75) Inventors: Bryan Youngpeter, Orion, MI (US); Dale C. Killins, Detroit, MI (US); Stephen T. Hung, Grosse Pointe, MI (US); Timothy M. Staton, Ypsilanti, MI (US); Scott L. Radabaugh, Ann Arbor, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 162 days.

(21) Appl. No.: 10/382,367

(22) Filed: Mar. 6, 2003

(65) Prior Publication Data

US 2004/0042913 A1 Mar. 4, 2004

Related U.S. Application Data

(60) Provisional application No. 60/407,918, filed on Sep. 3, 2002.

(51) Int. Cl.[7] ..... F04B 49/24; F04C 2/344

(52) U.S. Cl. ..... 417/310; 418/259

(58) Field of Search ..... 417/310; 418/149, 418/259, 269

(56) References Cited

U.S. PATENT DOCUMENTS 2,809,595 A * 10/1957 Adams et al. ..... 418/149
5,887,612 A 3/1999 Bleitz et al.
6,068,461 A * 5/2000 Haga et al. ..... 418/259
6,149,409 A * 11/2000 Palakodati et al. ..... 418/259
6,287,094 B1 9/2001 Bleitz et al.
6,648,620 B2 * 11/2003 Yamauchi et al. ..... 418/259

FOREIGN PATENT DOCUMENTS

| | | |
|---|---|---|
| EP | 0481347 | * 4/1992 |
| JP | 59-221488 | * 12/1984 |
| JP | 3-222882 | * 10/1991 |
| JP | 4-66789 | * 3/1992 |

* cited by examiner

*Primary Examiner*—Michael Koczo, Jr.
(74) *Attorney, Agent, or Firm*—Brinks Hofer Gilson & Lione

(57) ABSTRACT

A power steering pump comprises, as main elements, a cam plate, a discharge cover plate and a suction cover plate that cooperate to define a cam chamber, a fluid discharge passage and fluid suction passage for the pump. The cam chamber is formed in the cam plate. The discharge cover plate includes a face that abuts a first face of the cam plate and includes a recess that cooperates with first cam plate face to define a fluid discharge passage. A suction cover plate includes a suction cover face that abuts a second face of the cam plate and comprises a recess that cooperates with the second cam plate face to define a suction passage. The power steering pump further comprises a rotor within the cam chamber and comprising slideable vanes.

16 Claims, 5 Drawing Sheets

POWER STEERING PUMP

RELATED APPLICATIONS

The present patent document claims the benefit of the filing date under 35 U.S.C. § 119(e) of Provisional U.S. Patent Application Ser. No. 60/407,918, filed Sep. 3, 2002, which is hereby incorporated by reference.

TECHNICAL FIELD OF THE INVENTION

This invention relates to a power steering pump for an automotive vehicle. More particularly, this invention relates to a power steering pump wherein a cam plate, a discharge cover plate and a suction cover plate cooperate to define a cam chamber, a fluid discharge passage and a fluid suction passage for the pump.

BACKGROUND OF THE INVENTION

A power steering pump for an automotive vehicle comprises a pump for providing hydraulic fluid under pressure. U.S. Pat. No. 5,887,612, issued Bleitz et al. in 1999, shows a power steering pump of conventional design. The pump comprises a cam element sandwiched between upper and lower pressure plates that cooperate to form a cam chamber, and a rotor having retractable vanes located within the cam chamber. The arrangement of the cam element, upper and lower pressure plates and rotor is assembled within a housing that defines a suction passage for drawing fluid into the cam chamber through openings in the pressure plates and a discharge passage for receiving pumped fluid from the cam chamber through additional openings in the pressure plates. The housing includes an outlet communicating with the discharge passage for outputting pressurized fluid to the power steering system, and an inlet connected to a return line for cycling fluid back to the pump. A feature of the power steering pump described in Bleitz et al. is that the housing also defines a bypass that communicates with the suction passage, and a flow control mechanism. During operation, the rotor is driven by the engine through a belt and a pulley. At high engine speeds, the volume of pumped fluid is greater than the desired output for the system. Under these circumstances, the flow control mechanism diverts a portion of the pumped fluid from the output to the bypass passage which in turn leads to the suction passage. As much as 90% of the pumped fluid may be recycled internally within the pump through the bypass. The recycling of pumped fluid is critical to maintaining the pump output at the desired level for operation of the power steering system.

Conventional designs for power steering pumps thus require a large number of components that add significantly to the complexity and cost of the power steering pump. It is pointed out that the upper pressure plate includes openings for both the suction passage and the discharge passage, as also does the lower pressure plate. This arrangement for communicating with openings in both pressure plates further adds to the complexity of the design for the various passages within the housing.

Therefore, a need exists for a power steering pump that features a reduced number of components and a simpler design for the several passages for supplying, discharging and bypassing fluid.

BRIEF SUMMARY OF THE INVENTION

In accordance with this invention, a power steering pump comprises, as main elements, a cam plate, a discharge cover plate, and a suction cover plate, that cooperate to define a cam chamber, a fluid discharge passage and a fluid suction passage for the pump. The cam plate defines a cam chamber and has a first face and a second face. The discharge cover plate includes a discharge cover face in juxtaposition with the first cam plate face. The discharge cover face includes a recess that cooperates with the first cam plate face to define a fluid discharge passage. The fluid discharge passage includes a portion that overlies the cam chamber to provide an outlet for discharging pressurized fluid from the cam chamber. The suction cover plate includes a suction cover face in juxtaposition with the second cam plate face. The suction cover face comprises a recess that cooperates with the second cam plate face to define a suction passage, which suction passage includes a portion that overlies the cam chamber to provide an inlet for supplying fluid to the cam chamber. The power steering pump further comprises a rotor rotatably disposed within the cam chamber and including a plurality of radial slots and vanes slideably received in the slots. Thus, this invention provides an efficient and compact design wherein the main elements cooperate to define the pumping chamber and the passages for conveying fluid to and from the pumping chamber, thereby decreasing the number of main elements required to manufacture the power steering pump and thus reducing the cost of the power steering pump.

BRIEF DESCRIPTION OF THE DRAWINGS

The invention will be further described with reference to the following drawing wherein.

DETAILED DESCRIPTION OF THE INVENTION

Figure 1:
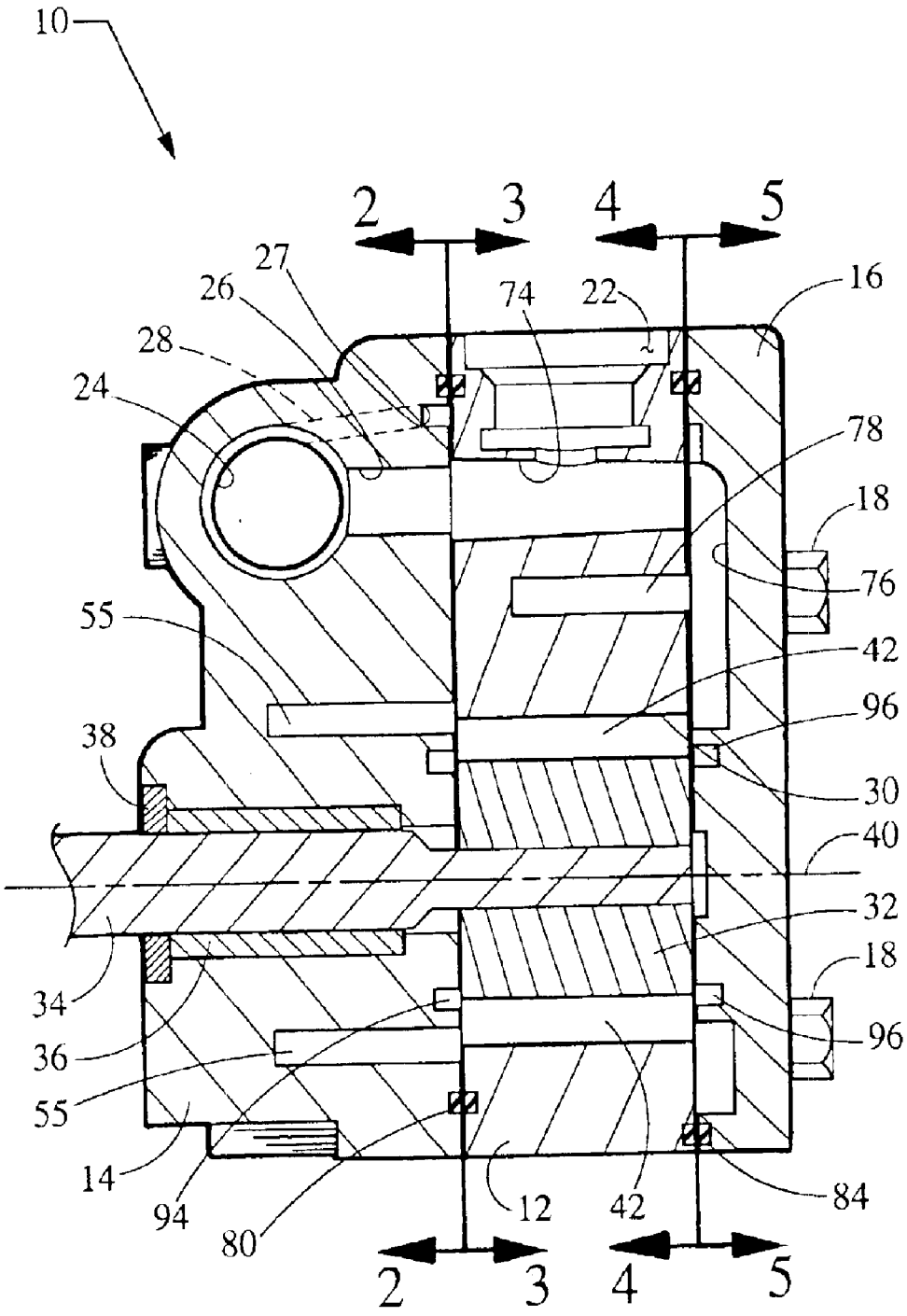
FIG. 1 is a cross-sectional view of a power steering pump in accordance with this invention.

In accordance with a preferred embodiment of this invention, referring to FIGS. 1–5, a power steering pump 10 is adapted for use in a power steering system in an automotive vehicle and supplies pressurized hydraulic fluid to a power steering gear, which fluid is then returned to the pump. Pump 10 comprises, as main elements, a cam plate 12, a discharge cover plate 14 and a suction cover plate 16. Plates 12, 14 and 16 are joined together by bolts 18 through bores 20 in the plates. Pump 10 comprises an inlet 22 preferably formed in cam plate 12. Alternately, the inlet may be located elsewhere, including in plates 14 or 16, by designing suitable internal fluid passages within the pump. During use, a reservoir is mounted on pump 10 and has an outlet for supplying fluid to inlet 22. The outlet for the pump is through a bore 24 formed in plate 14. An adaptor 25 is threaded or otherwise suitably coupled to an open end of bore 24 for connecting pump 10 to a pipe for delivering pressurized fluid to a steering gear. It is a feature of pump 10 that the pump includes a bypass port 26 for recycling a portion of the pumped fluid within the pump. Bore 24 houses a flow control mechanism that regulates the output from pump 10 and includes a flow control valve for opening and closing bypass port 26. A suitable flow control mechanism is described in U.S. Pat. No. 5,887,612, issued Bleitz et al. in 1999, and incorporated herein by reference. An improved flow control mechanism is described in U.S. patent application Ser. No. 10/358,056, filed by Youngpeter et al. on Feb. 4, 2003, and assigned to the assignee of the present invention, which is also incorporated herein by reference. The mechanisms of the aforementioned patent documents utilize a pressure sensing passage that communicates with end regions of the bore spaced apart about the bypass port. For this purpose, pump 10 includes bores 28 that communicate with bore 24 and are coupled through passage 27.

Cam plate 12 defines a cam chamber 30. A rotor 32 is disposed within cam chamber 30 and is mounted on a shaft 34 that extends through a bore in cover plate 14. A bushing 36 is disposed about shaft 34 to facilitate rotation, and a seal 38 is provided about shaft 34 to prevent fluid leakage. During use, shaft 34 is driven by an engine through a belt and pulley assembly to rotate rotor 32 about axis 40 in cam chamber 30. Rotor 32 comprises a plurality of radial vanes 42 slideably received in radial slots 43 in the rotor. During operation, as rotor 32 turns, vanes 42 slide against the surface of cam chamber 30 to pressurize fluid within the space between the rotor and cam chamber 30 surface. Because of the non-circular shape of the cam chamber 30, the cam chamber forms regions 46 wherein the radial spacing between rotor 32 and the surface of cam chamber 30 is relatively large and contains fluid at relatively low pressure. Thus, inlets are disposed at regions 46 for drawing low pressure fluid into the cam chamber 30, as hereinafter described. Also, cam chamber 30 and rotor 32 cooperate to form regions 47 wherein the radial spacing is narrow. During operation, as rotor 32 turns, vanes 42 compress fluid within regions 47, thereby pressurizing the fluid. Accordingly, outlets are provided for discharging fluid from the cam chamber 30 at the regions 47, as hereinafter described.

Figure 2:
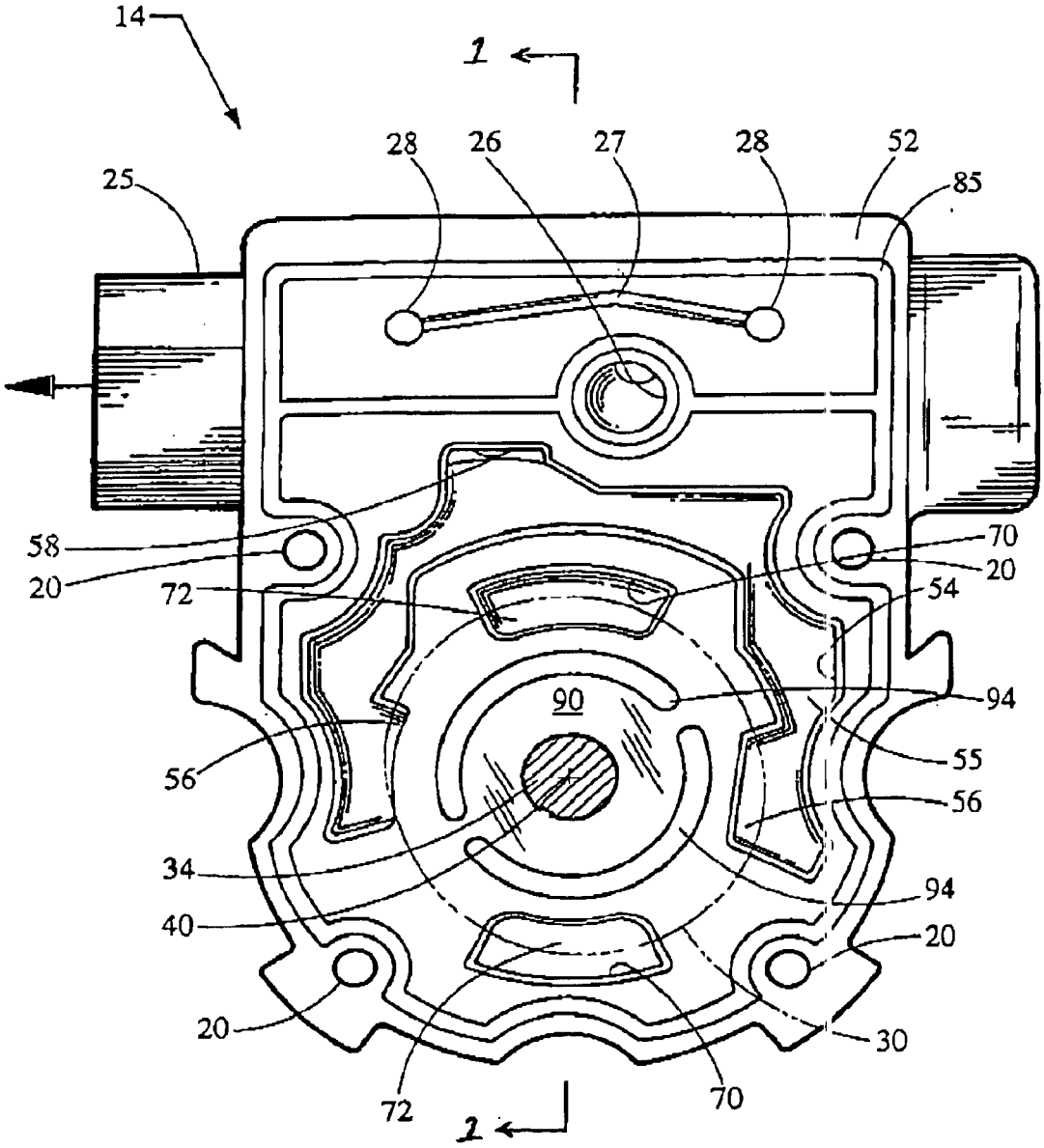
FIG. 2 is a plan view of a face of the discharge cover plate of the power steering pump in FIG. 1, taken along line 2—2 in the direction of the arrows.
Figure 3:
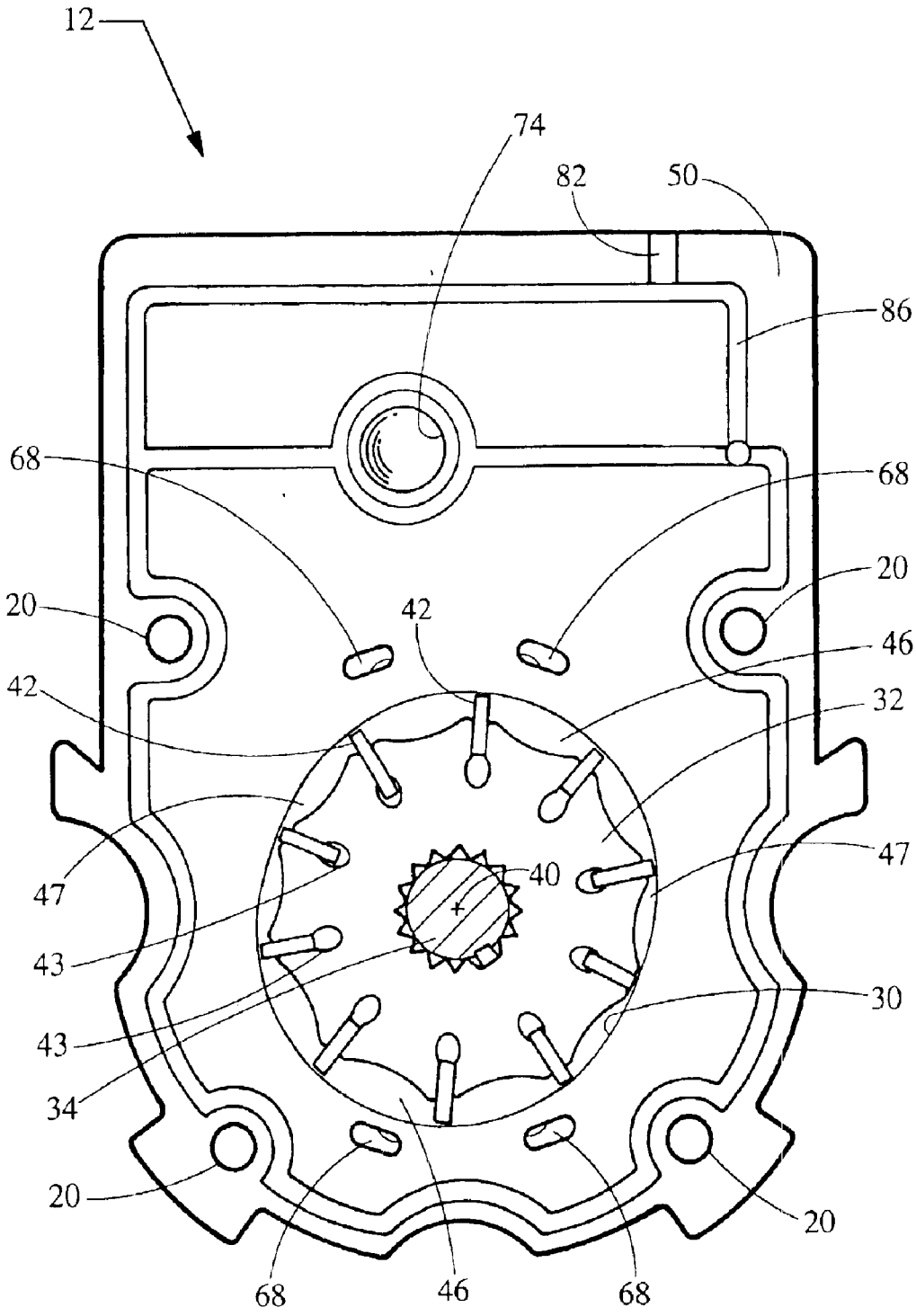
FIG. 3 is a view of a face of the cam plate of the power steering pump in FIG. 1, taken along line 3—3 in the direction of the arrows.

Referring more particularly to FIGS. 2 and 3, cam plate 12 includes a first cam plate face 50 that mates against a face 52 of discharge cover plate 14. A recess 54 is defined in face 52 and cooperates with face 50 to define the discharge passage 55. Referring particularly to FIG. 2, the profile for cam chamber 30 is shown in phantom and overlaps recess 54 to form outlets 56 for discharging fluid from the cam chamber 30. A fluid discharge port 58 provides communication between recess 54 and bore 24.

Figure 4:
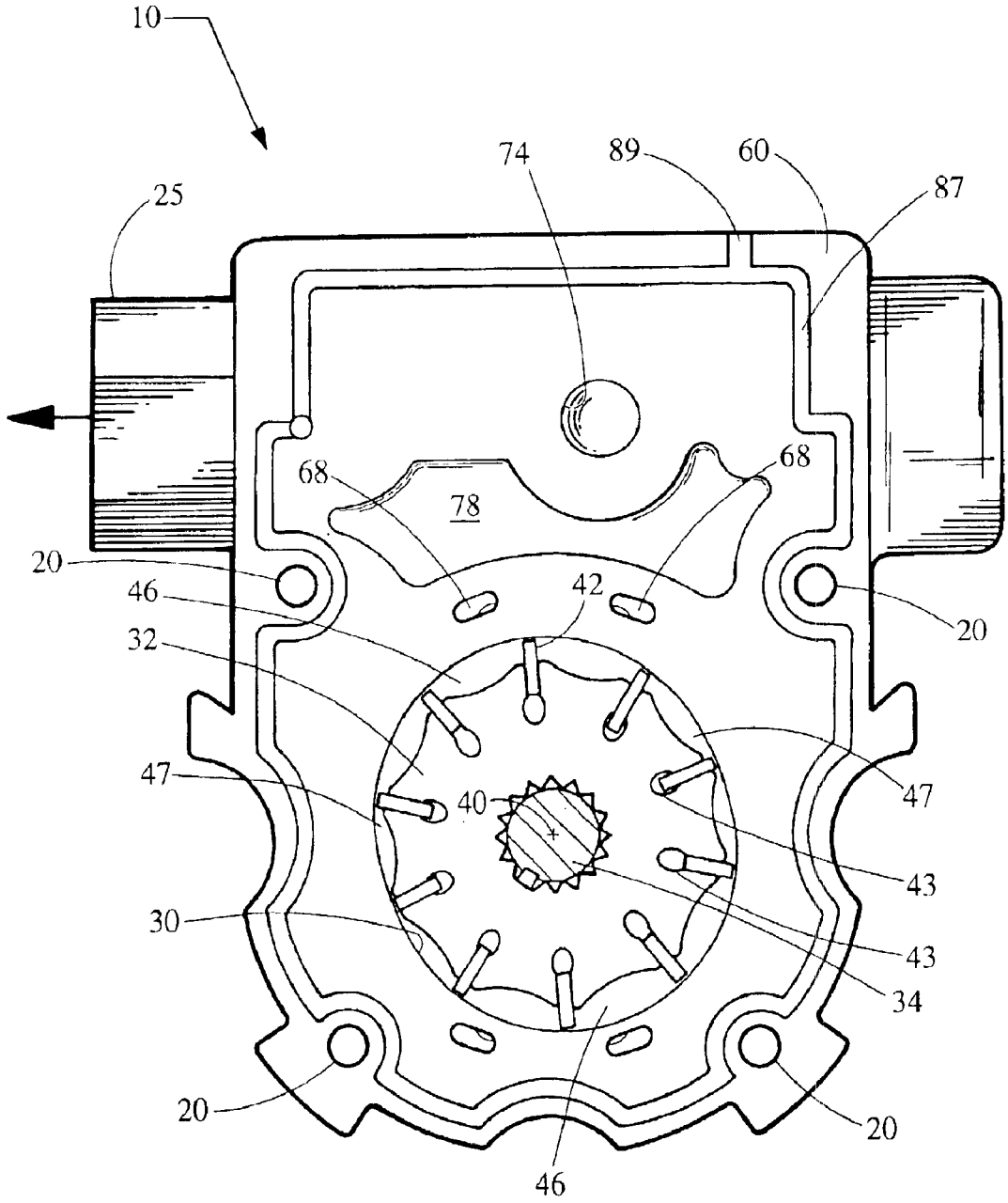
FIG. 4 is a view of a face of the cam plate of the power steering pump in FIG. 1 taken along line 4—4 in the direction of the arrows.
Figure 5:
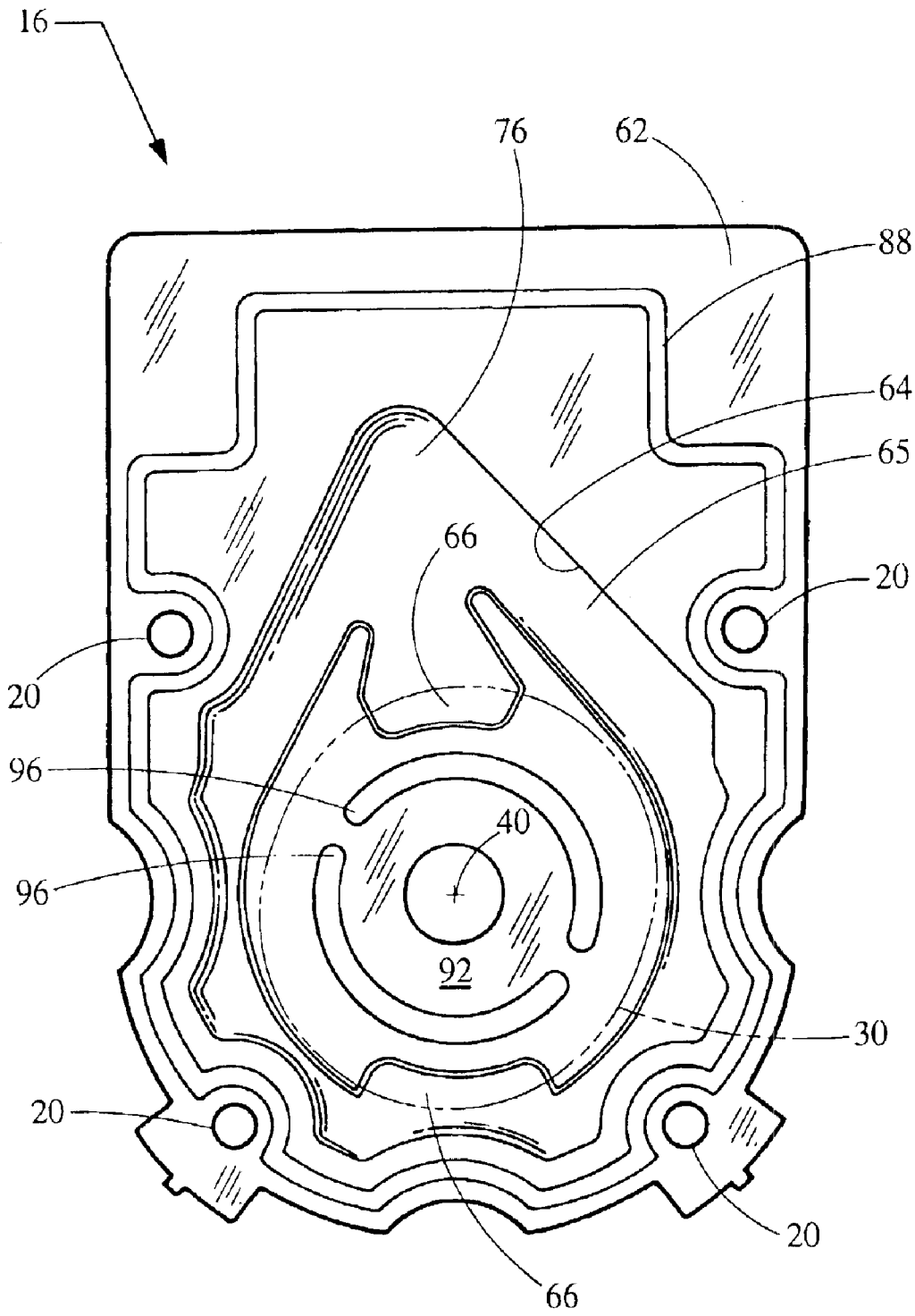
FIG. 5 is a view of a face of the suction cover plate for the power steering pump in FIG. 1, taken along line 5—5 in the direction of the arrows.

Referring more particularly to FIGS. 4 and 5, cam plate 12 comprises a second cam plate face 60 that mates against face 62 of suction cover plate 16. A recess 64 is formed in face 62 and cooperates with face 60 to define a suction passage 65 for supplying fluid to cam chamber 30. Referring to the cam chamber profile shown in phantom in FIG. 5, recess 64 overlaps cam chamber 30 to form inlets 66 for supplying fluid to the cam chamber 30. In addition, low pressure fluid flows through passages 68 in cam plate 12 into recesses 70 in discharge cover plate 14, which recesses 70 also overlap cam chamber 30 to provide additional inlets 72 to the cam chamber 30, thereby providing more uniform flow of low pressure fluid into the cam chamber 30. The fluid is supplied to suction passage 65 through a fluid diffuser passage 74 formed in cam plate 12. Diffuser 74 communicates with inlet 22 and also with bypass port 26. Diffuser 74 features a conical shape generally parallel to axis 40. Diffuser 74 directs fluid against a reflector 76 in recess 64 to provide more uniform flow through suction passage 65. A reservoir 78 formed in cam plate 12 communicates with solution passage 65 to facilitate a continuous supply of low pressure fluid through the suction passage.

A fluid seal 80 is provided between face 50 of cam plate 12 and face 52 of discharge cover plate 14. For this purpose, a groove 85 is provided in face 50 and registers with a groove 86 in face 52. Following assembly of discharge cover plate 14 against cam plate 12, a polymeric material is injected through inlet 82 to fill the grooves and form seal 80. Similarly, a seal 84 is formed between face 60 of cam plate 12 and face 62 of suction cover plate 16. For this purpose, a groove 87 is provided in face 60 that registers with a groove 88 in face 62. Following assembly of suction cover plate 16 against cam plate 12, polymeric material is injected through inlet 89 to fill the grooves and form seal 84.

Face 52 of discharge cover plate 14 includes a land 90 that retains rotor 32 in cam chamber 30. Similarly, face 62 of suction cover plate 16 includes a land 92 for retaining the rotor. Porting 94 in face 52 and porting 96 in face 62 distribute pressurized fluid from discharge passage 55 to slots 43 in rotor 32 to urge vanes 42 against the surface of cam chamber 30.

During operation, shaft 34 is driven by the engine through a belt and pulley connection. Shaft 34 rotates rotor 32 within cam chamber 30. Fluid from a reservoir is supplied through inlet 22 to diffuser 74 and combines with fluid from bypass port 26, when the flow control valve opens to recycle excess fluid. Diffuser 74 directs fluid into suction passage 65 against reflector 76, whereafter the fluid is drawn into cam chamber 30 through inlets 66 and 72. Within cam chamber 30, vanes 42 compress the fluid and discharge pressurized fluid from outlets 56 to discharge passage 55 and through fluid discharge port 58 to bore 24, whereupon the pressurized fluid is outputted through adaptor to the power steering pump.

Therefore, this invention provides a power steering pump that uses a minimal number of housing elements to define the cam chamber for pumping and the passages to and from the cam chamber. It is an advantage of this invention that the cam plate, the discharge cover plate and the suction cover plate are readily formed of aluminum alloy by die casting. Dies are readily configured to mold the recesses in the discharge cover plate and the suction cover plate that form the basis for the discharge passage and the suction passage in the pump. By appropriately configuring the dies, the main elements may be molded to near net shape, thereby reducing the finish machining required to finish the plates and manufacture the pump. Thus, this invention provides a power steering pump that may be readily manufactured at reduced cost.

While this invention has been described in terms of certain embodiments thereof, it is not intended to be limited to those embodiments, but rather only to the extent set forth in the claims that follow.

What is claimed is:

1. A power steering pump comprising:

a cam plate defining a cam chamber, said cam plate having a first face and a second face;

a rotor disposed within the cam chamber and rotatable about an axis, said rotor comprising a plurality of slots and vanes slideably received in the slots;

a discharge cover plate having a discharge cover face overlying the first face of the cam plate and comprising at least one recess that cooperates with said first face to define a fluid discharge passage and includes a portion that overlies the cam chamber to provide an outlet for discharging fluid from the cam chamber to the fluid discharge passage;

a suction cover plate having a suction cover face overlying the second face of the cam plate and comprising at least one recess that cooperates with said second face to define a suction passage and includes a portion that overlies the cam chamber to provide an inlet for supplying fluid from the suction passage to the cam chamber; and a pump outler in said discharge cover plate and communicating with the discharge passage.

2. A power steering pump according to claim 1, wherein the power steering pump comprises a pump inlet communicating with the suction passage for supplying fluid to the pump.

3. A power steering pump according to claim 1, wherein said power steering pump further comprises a shaft connected to the rotor and rotatably mounted through a bore in at least one of said discharge cover plates and said suction cover plate.

4. A power steering pump according to claim 1, further comprising a groove in said first face of said cam plate and a groove in said discharge cover face in registration with said groove in said cam plate, and a seal disposed within said grooves.

5. A power steering pump according to claim 1, further comprising a groove in said second face of said cam plate and a groove in said suction cover face in registration with said groove in said cam plate, and a seal disposed within said grooves.

6. A power steering pump comprising:

a cam plate defining a cam chamber, said cam plate having a first face and a second face;

a rotor disposed within the cam chamber and rotatable about an axis, said rotor comprising a plurality of slots and vanes slideably received in the slots;

a discharge cover plate having a discharge cover face overlying the first face of the cam plate and comprising at least one recess that cooperates with said first face to define a fluid discharge passage and includes a portion that overlies the cam chamber to provide an outlet for discharging fluid from the cam chamber to the fluid discharge passage; and a suction cover plate having a suction cover face overlying the second face of the cam plate and comprising at least one recess that cooperates with said second face to define a suction passage and includes a portion that overlies the cam chamber to provide an inlet for supplying fluid from the suction passage to the cam chamber, wherein the cam plate defines a diffuser for supplying fluid to said recess in said discharge cover plate.

7. A power steering pump according to claim 6, wherein the power steering pump comprises a pump inlet communicating with the suction passage for supplying fluid to the pump.

8. A power steering pump according to claim 6, wherein said power steering pump further comprises a shaft connected to the rotor and rotatably mounted through a bore in at least one of said discharge cover plates and said suction cover plate.

9. A power steering pump according to claim 6, further comprising a groove in said first face of said cam plate and a groove in said discharge cover face in registration with said groove in said cam plate, and a seal disposed within said grooves.

10. A power steering pump according to claim 6, further comprising a groove in said second face of said cam plate and a groove in said suction cover face in registration with said groove in said cam plate, and a seal disposed within said grooves.

11. A power steering pump comprising:

a cam plate defining a cam chamber having an axis and comprising a first face and a second face, said cam plate further comprising a diffuser extending generally parallel to said axis between said first face and said second face;

a rotor disposed within the cam chamber and rotatable about the axis, said rotor comprising a plurality of slots and vanes slideably received in the slots;

a discharge cover plate having a discharge cover face overlying the first face of the cam plate and comprising a recess that cooperates with said first face to define a fluid discharge passage and includes a portion that overlies the cam chamber to provide an outlet for discharging fluid from the cam chamber to the fluid discharge passage;

a suction cover plate having a suction cover face overlying the second face of the cam plate and comprising a recess that cooperates with said second face to define a fluid suction passage and includes a portion that overlies the cam chamber to provide an inlet for supplying fluid to the cam chamber, said recess including a region overlying said diffuser for receiving fluid therefrom;

an inlet communicating with said diffuser; and an outlet in fluid communication with said fluid discharge passage.

12. A power steering pump according to claim 11, further comprising a fluid bypass port communicating with said fluid discharge passage and with said diffuser for recycling fluid to said fluid suction passage.

13. A power steering pump according to claim 11, wherein the inlet port is formed in said cam plate.

14. A power steering pump according to claim 11, wherein the outlet is formed in said discharge cover plate.

15. A power steering pump according to claim 11, further comprising a shaft connected to said rotor and extending through said discharge cover plate.

16. A power steering pump according to claim 11, wherein said discharge cover plate comprises a recess overlying a portion of said cam chamber to provide an inlet to said cam chamber and wherein the cam plate includes passages connecting said recess in said discharge cover plate to said fluid suction passage.

* * * * *

UNITED STATES PATENT AND TRADEMARK OFFICE

CERTIFICATE OF CORRECTION

PATENT NO. : 6,899,528 B2
DATED : May 31, 2005
INVENTOR(S) : Bryan Youngpeter et al.

It is certified that error appears in the above-identified patent and that said Letters Patent is hereby corrected as shown below:

Column 5,
Line 10, after "pump" delete "outler" and substitute -- outlet -- in its place.

Signed and Sealed this

Fourth Day of October, 2005

JON W. DUDAS
*Director of the United States Patent and Trademark Office*